US007708113B1

(12) United States Patent
Prior

(10) Patent No.: US 7,708,113 B1
(45) Date of Patent: May 4, 2010

(54) VARIABLE FREQUENCY SOUND ATTENUATOR FOR ROTATING DEVICES

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/430,352

(22) Filed: Apr. 27, 2009

(51) Int. Cl.

| | |
|---|---|
| ***F02M 35/00*** | (2006.01) |
| ***F02M 35/10*** | (2006.01) |
| ***F01N 1/02*** | (2006.01) |
| ***F02B 27/02*** | (2006.01) |
| ***F02B 33/00*** | (2006.01) |
| ***F01C 1/16*** | (2006.01) |
| ***F01C 1/18*** | (2006.01) |
| ***F01C 21/00*** | (2006.01) |

(52) U.S. Cl. ..... 181/229; 181/250; 60/312; 123/184.57; 123/559.1; 418/178; 418/179; 418/201.1; 418/206.5

(58) Field of Classification Search ..... 181/229, 181/250; 123/184.57, 559.1; 418/178, 179, 418/201.1, 206.5; 60/312
See application file for complete search history.

(56) References Cited

U.S. PATENT DOCUMENTS

| | | | | | |
|---|---|---|---|---|---|
| 3,750,393 | A * | 8/1973 | Minto et al. | ..... | 60/650 |
| 3,796,527 | A * | 3/1974 | Woodier et al. | ..... | 418/115 |
| 4,546,733 | A * | 10/1985 | Fukami et al. | ..... | 123/184.57 |
| 5,180,299 | A * | 1/1993 | Feuling | ..... | 418/190 |
| 5,320,508 | A * | 6/1994 | Kiefer | ..... | 418/206.5 |
| 5,333,576 | A * | 8/1994 | Verkleeren | ..... | 123/184.53 |
| 5,377,407 | A * | 1/1995 | Takahashi et al. | ..... | 29/889 |
| 5,638,600 | A * | 6/1997 | Rao et al. | ..... | 29/888.02 |
| 5,772,418 | A * | 6/1998 | Tateno et al. | ..... | 418/206.5 |
| 5,970,611 | A * | 10/1999 | Takabe et al. | ..... | 29/888.023 |
| 6,142,759 | A * | 11/2000 | Tateno et al. | ..... | 418/206.5 |
| 6,234,765 | B1 * | 5/2001 | Deak | ..... | 417/321 |
| 6,508,331 | B1 * | 1/2003 | Stuart | ..... | 181/250 |
| 6,688,867 | B2 * | 2/2004 | Suman et al. | ..... | 418/178 |
| 6,874,486 | B2 * | 4/2005 | Prior et al. | ..... | 123/559.1 |
| 6,918,749 | B2 * | 7/2005 | Garczorz et al. | ..... | 417/410.4 |
| 6,938,670 | B2 * | 9/2005 | Maeyama et al. | ..... | 164/111 |
| 2004/0208770 | A1 * | 10/2004 | Prior | ..... | 418/201.1 |
| 2005/0150718 | A1 * | 7/2005 | Knight et al. | ..... | 181/250 |
| 2006/0150948 | A1 * | 7/2006 | Pontiggia | ..... | 123/241 |
| 2006/0263230 | A1 * | 11/2006 | Swartzlander | ..... | 418/196 |
| 2008/0060622 | A1 * | 3/2008 | Prior | ..... | 123/559.1 |
| 2008/0168961 | A1 * | 7/2008 | Prior et al. | ..... | 123/184.57 |
| 2008/0170958 | A1 * | 7/2008 | Prior et al. | ..... | 418/179 |
| 2009/0148331 | A1 * | 6/2009 | Kaplan et al. | ..... | 418/201.1 |

* cited by examiner

*Primary Examiner*—Jeffrey Donels
*Assistant Examiner*—Christina Russell
(74) *Attorney, Agent, or Firm*—Cantor Colburn LLP

(57) ABSTRACT

A rotatable sound attenuation device is provided comprising a central portion rotatable about a first axis, a radial portion extending outwardly from the central portion and a chamber having a closed first end and a second end opening radially outwardly of the radial portion and defining a second axis therein having a radial component thereto. A piston is disposed within the chamber and is moveable to a location along the second axis in response to a centrifugal force imparted on the piston by rotation of the central portion and the radial portion about the first axis. A biasing member operates to limit movement of the piston along the second axis. A quarter wave chamber is defined by the second, open end of the chamber and the piston and has a sound attenuating length defined by the location of the piston along the second axis of the chamber.

13 Claims, 6 Drawing Sheets

VARIABLE FREQUENCY SOUND ATTENUATOR FOR ROTATING DEVICES

FIELD OF THE INVENTION

Exemplary embodiments of the present invention are related to variable frequency noise attenuation for rotating devices and, more specifically, to a quarter wave tube having a variable length and volume.

BACKGROUND

The application of internal combustion engines, whether stationary or mobile, often requires significant noise, vibration and harshness ("NVH") engineering to reduce naturally generated sound frequencies. Rotating devices installed in, or associated with, internal combustion engines are a common contributor to such noise. Rotating parts such as fan blades or supercharger lobes may generate sound that varies over a range of frequencies; primarily as a function of the rotational velocity of the component. Additionally, rotating components may also produce noise as they pass by stationary objects.

Under-hood and induction system noise associated with an automotive internal combustion engine is a target of significant NVH focus due to the desirability of providing a quiet and comfortable driving experience for the operator of the vehicle. Induction noise produced by the engine depends on the particular engine configuration and may be affected by such factors as the number of cylinders, and the volume and shape of the intake manifold, plenum and intake runners. The application of induction compression through the use of an engine driven supercharger, or an exhaust driven turbocharger, may also contribute substantially to under-hood noise. Other under-hood sound produced by the engine may be contributed by rotating accessory drives, associated accessories and fans for cooling the engine.

Quarter wave tubes produce a sound-canceling wave of a frequency that is tuned to a wavelength four times longer than the quarter wave tube. Quarter wave tubes are often used to reduce sound generated by engine induction systems, but are typically of a fixed length and are therefore limited to addressing specific frequencies. Noise of varying frequency or noise of several different orders, such as may be produced by variable-speed rotating components, may require the use of multiple quarter wave tubes or other sound attenuation solutions that can be costly, difficult to package and of limited effectiveness.

Accordingly, it is desirable to provide a sound attenuator such as a quarter wave tube that can attenuate varying sound frequencies that are generated by rotating devices.

SUMMARY OF THE INVENTION

In one exemplary embodiment of the present invention, a variable frequency sound attenuation device is provided comprising a central portion rotatable about a first axis, a radial portion extending outwardly from the central portion, a chamber defined by the radial portion and having a closed first end and a second end opening outwardly of the radial portion and a second axis defined by the chamber and having a radial component. A piston is disposed within the chamber and is moveable along the second axis in response to a centrifugal force imparted on the piston by rotation of the central portion and the radial portion about the first axis. A biasing member, having a first end fixed within the chamber and a second end fixed to the piston, is configured to limit movement of the piston along the second axis. A variable length, quarter wave chamber is defined by the chamber, the second, open end of the chamber and the piston and has a variable frequency, sound attenuating length defined by the location of the piston along the second axis of the chamber.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Other objects, features, advantages and details appear, by way of example only, in the following detailed description of embodiments, the detailed description referring to the drawings in which.

DESCRIPTION OF THE EMBODIMENTS

Figure 1:
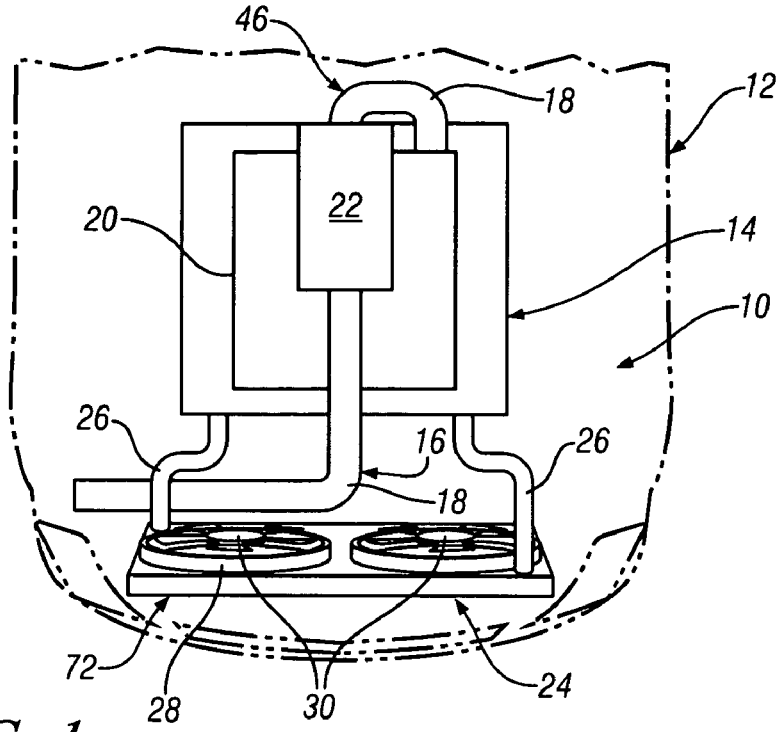
FIG. 1 is a schematic, plan view of an engine compartment of a motor vehicle.

In accordance with an exemplary embodiment of the present invention, FIG. 1 illustrates an under-hood region 10 of a motor vehicle 12. An internal combustion engine 14 may comprise one of a straight configuration, a v-configuration, a flat/boxer configuration or other know configuration without deviating from the scope of the invention. Additionally the internal combustion engine 14 may include any number of cylinders such as 3, 4, 5, 6, 8, 10 or 12 as are commonly used across a wide range of vehicle applications. A combustion air intake system, referred to generally as 16, includes air induction conduits 18, an air intake manifold 20 and, in the configuration shown in FIG. 1, a supercharger 22 for compressing combustion air prior to delivery to the intake manifold 20 and thereby enhancing the performance of the internal combustion engine 14.

A cooling system 24 is configured to circulate a cooling medium, such as a mixture of glycol and water, through the internal combustion engine 14 to remove excess heat therefrom. The cooling system will typically include coolant hoses 26 that conduct coolant to and from a radiator 28. The radiator 28 is generally associated with one or more cooling fans 30 which may be engine driven or electrically powered and are configured to force air over cooling fins (not shown) in the radiator 28 to thereby remove heat from the cooling medium flowing therethrough.

Figure 2:
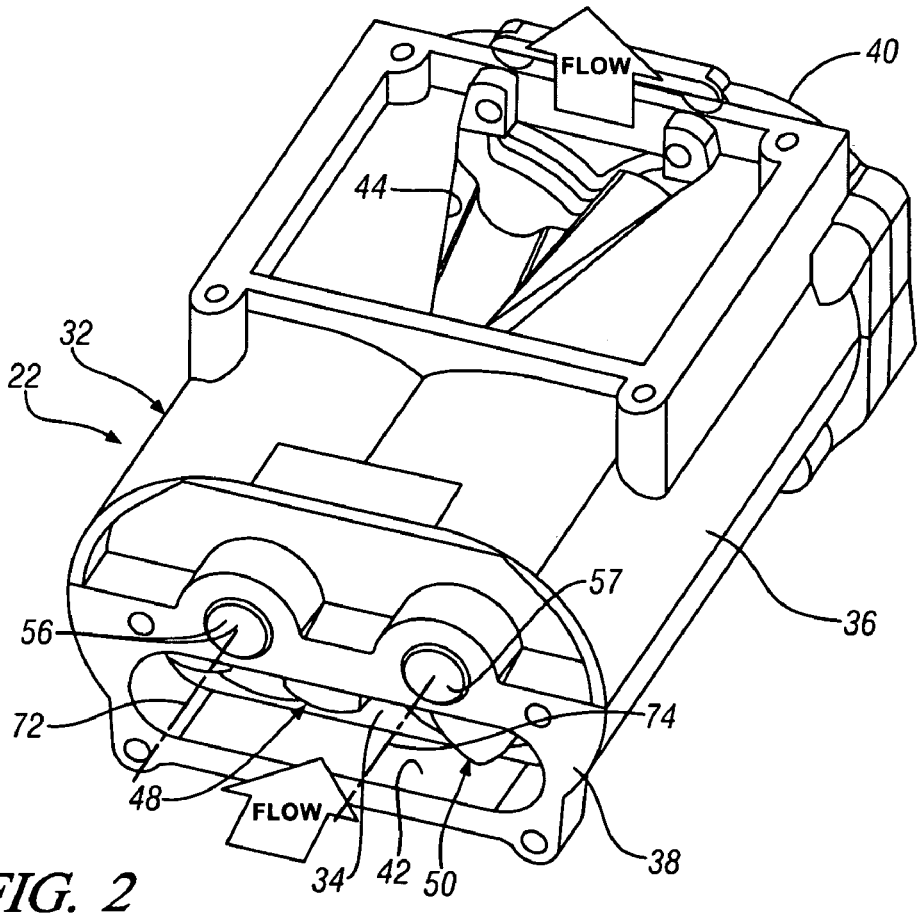
FIG. 2 is a perspective view of an automotive supercharger.
Figure 3:
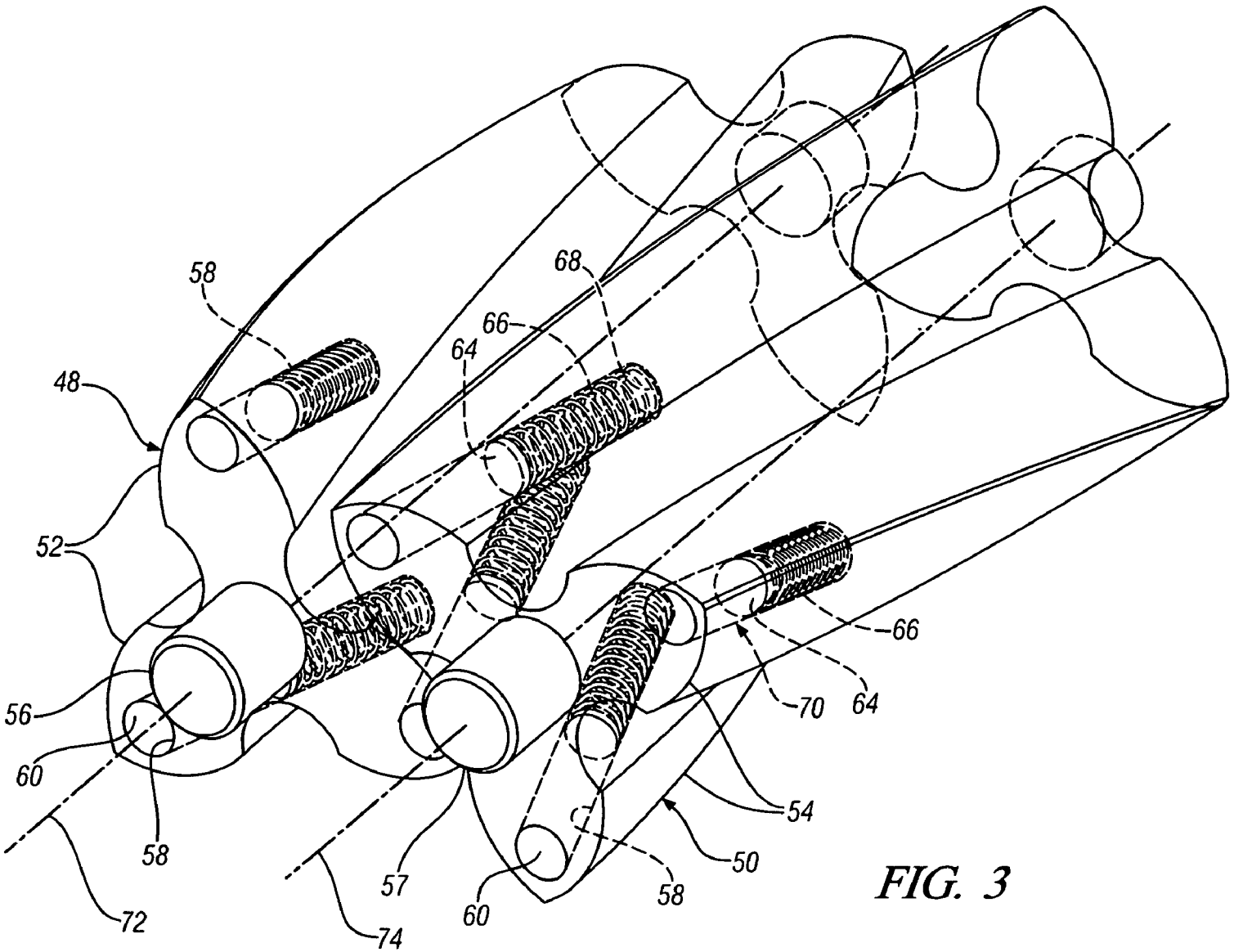
FIG. 3 is perspective view of the interleaved rotors of the supercharger of FIG. 2.

Referring now to FIGS. 2 and 3, in an exemplary embodiment the supercharger 22 may be a positive displacement, helical lobed supercharger that includes an axially extending housing 32 having an internal cavity 34 defined by a surrounding wall 36 and upstream and downstream end walls 38 and 40, respectively. An inlet opening 42 in the upstream end wall 38 fluidly communicates the internal cavity 34 with a source of inlet air from the combustion air intake system 16. An outlet opening 44 extends through the surrounding wall 36, adjacent the downstream end wall 40 of the axially extending housing 32, and communicates the internal cavity 34 with a pressurized side 46, FIG. 1, of the combustion air intake system 16. Within the internal cavity 34 there are rotatably mounted a pair of supercharger rotors 48 and 50 each having a plurality of radially extending portions or lobes 52 and 54 with opposite helix angles. The rotor lobes 52 and 54 are interleaved when assembled into the internal cavity 34 of supercharger housing 32 to define, with the housing, a series of helical rotor chambers (not shown). In the exemplary embodiment illustrated, the radially extending rotor lobes 52 and 54 are twisted with equal and opposite helix angles. The direction of twist of rotor lobes 52 from the inlet opening 42 to the outlet opening 44 is counter-clockwise, while the direction of twist, or helical change, of the rotor lobes 54 is clockwise. An engine driven shaft (not shown) that may be belt, chain or gear driven, rotates the supercharger rotors 48, 50 on axially extending central portions or rotor shafts 56 and 57 that define rotor shaft axes 72 and 74, respectively. As engine speed increases the rotational speed of the supercharger rotors 48, 50 will also increase, drawing an increasing volume of combustion intake air through the inlet opening 42. The combustion air associated with the inlet opening 42 may be subject to pressure pulsations as a result of the rapid rotation of the rotor lobes 52, 54 as they index with the inlet opening 42.

Figure 4:
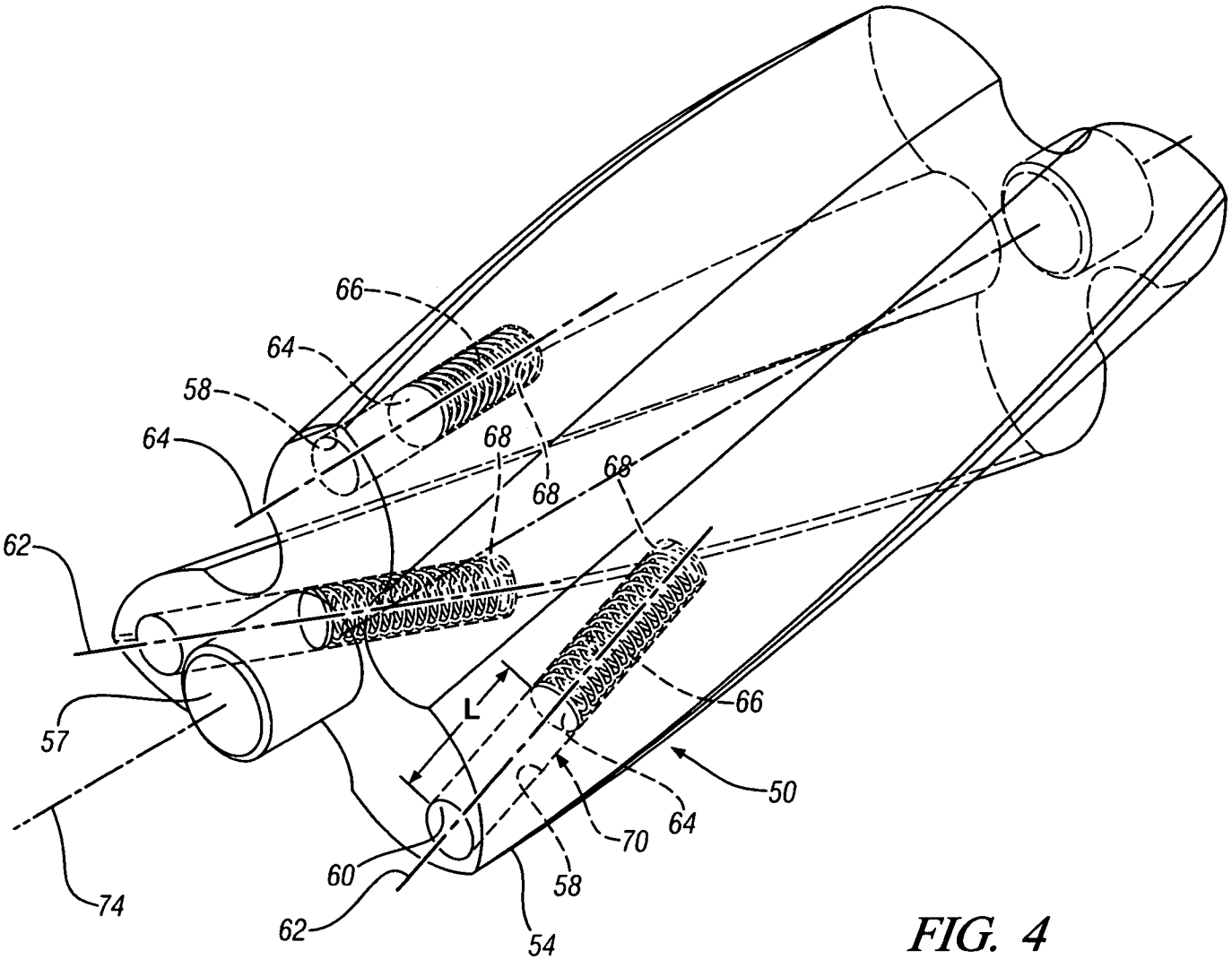
FIG. 4 is an enlarged view of one of the rotors of FIG. 3.

In an exemplary embodiment shown in detail in FIGS. 3 and 4, the radially extending rotor lobes 52 and 54 include hollow portions or chambers 58 that extend radially inwardly and axially, along a chamber axis 62, within at least a portion of each lobe. The chambers 58 may follow any suitable inwardly axial path that promotes rotational balance of the rotors 48, 50. The chambers 58 terminate through openings 60 adjacent the air inlet opening 42 associated with the upstream end wall 38 of the supercharger housing 32. The hollow supercharger rotors 48, 50 may be produced using methods such as drilling following forming, investment casting, helical pull die-casting or other suitable method of manufacturing and are typically constructed of a metal alloy, ceramic or other suitable material which is capable of exhibiting durability in a high temperature, high pressure environment. The rotor lobe chambers 38 are effective at reducing the rotating inertia of the rotor lobes 52, 54.

In an exemplary embodiment, the axes 62 of the rotor lobe chambers 58, FIG. 4, include both an axial component and a radial component with respect to the rotor shaft axes 72, 74. A piston 64 is disposed in each rotor lobe chamber 58 and is configured for movement within the chamber along the chamber axis 62. Biasing members such as springs 66 are disposed axially inwardly of each piston 64. The springs are attached to the rotor lobes 52 and 54 adjacent to the closed inner ends 68 of the rotor lobe chambers 58 as well as to the pistons 64 to prevent egress of the pistons through chamber openings 60 during operation of the supercharger. The plurality of radially extending rotor lobes 52, 54, the rotor lobe chambers 58 that terminate in openings 60 and the biased pistons 64 cooperate to define noise attenuation devices, or quarter wave tubes 70.

In an exemplary embodiment, during operation of the internal combustion engine 14, the engine driven central portions or rotor shafts 56, 57 rotate the supercharger rotors 48 and 50 and associated, radially extending rotor lobes 52 and 54. As a result of the radial component in the axis 62 of each rotor lobe chamber 58, relative to the axes 72, 74 of the rotor shafts 56 and 57, each of the pistons 64 will be subject to an outwardly directed centrifugal force within the lobe chambers as the rotors spin. As a result of the radially outwardly directed force, the pistons 64 will move, against the bias of springs 66, along the lobe chamber axes 62 towards the openings 60 of the lobe chambers 58, FIGS. 3 and 4.

The effect of the piston movement will be to shorten the length ("L") of the quarter wave tubes 70, resulting in a variable adjustment of the sound frequency attenuated by the quarter wave tubes based on the rotational speed of the engine 14 and associated rotational speed of the supercharger rotors 48 and 50. More specifically, as the rotational speed increases, the frequencies attenuated are higher than those attenuated at lower rotational speeds. Such a variation allows the pressure pulsations resident at the inlet of the supercharger housing 32 to be effectively reduced as they vary based on the rotational speed of the supercharger rotors 48, 50. A reduction in the rotational speed of the engine 14 and the supercharger rotors 48 and 50, and a consequent reduction in the inertial forces acting on pistons 64, will cause the biasing force of the springs 66 to retract the pistons 64 into the chambers 58 of the rotor lobes 52, 54 thereby increasing the length "L" of the quarter wave tubes 70; again resulting in a variable adjustment of the sound frequency attenuated based on the speed of the engine 14. As radial force acting on the piston is proportional to the square of the speed, a spring 66 having a non-linear spring rate may be required to achieve desired tuning properties over a range of engine speed. In the alternative, if only two sound frequencies require attenuation, the springs 66 may be linear and a piston stop (not shown) that is positioned at a desired location along the length of the chamber 58 may be used to fix the length "L" of the tube, at speed.

Figure 5:
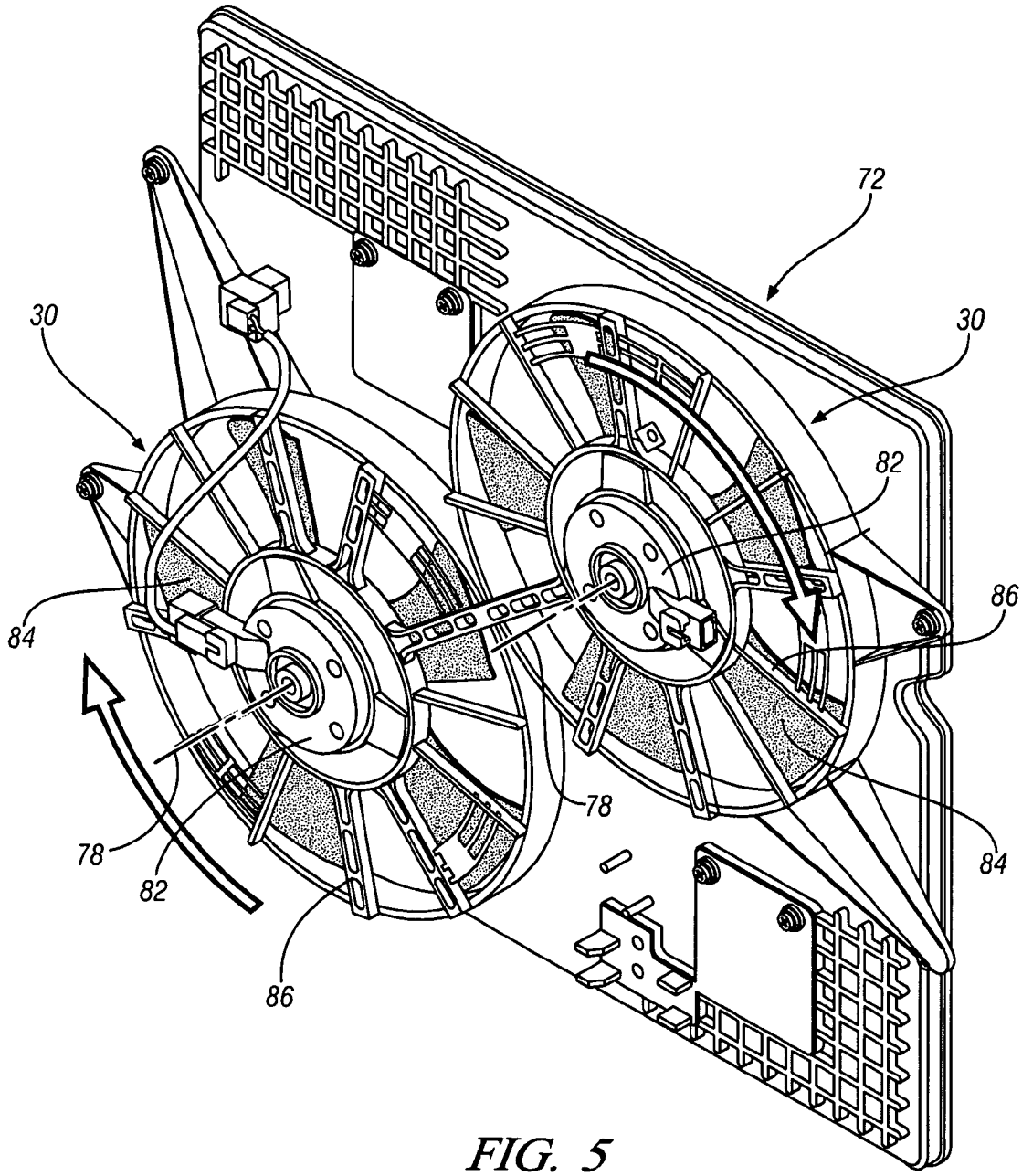
FIG. 5 is a perspective view of a cooling fan assembly.

Thus far, exemplary embodiments of the invention have been described with applicability to the rotating rotor lobes of a supercharger for an internal combustion engine. It should be apparent that the invention has other contemplated embodiments for variably reducing sound frequencies generated by rotating devices. Referring to FIG. 5, a fan shroud assembly 72 is shown for an automotive application such as that illustrated in FIG. 1. In the embodiment shown, the fan shroud assembly 72 includes two fans 30 mounted for rotation about fan motor axes 78 when powered by the electric motors 82. In many vehicles with varying loads and operating environments, the electric motors may rotate the fans 30 at varying speeds depending upon the thermal energy that must be removed from the engine 14. When little or no energy must be removed from the engine 14, the fans may run at a low speed or may be turned off to reduce both the noise generated by the fans and to save energy. In vehicles having an engine driven cooling fan, the fan's rotational speed may vary constantly with the speed of the engine 14.

Figure 6:
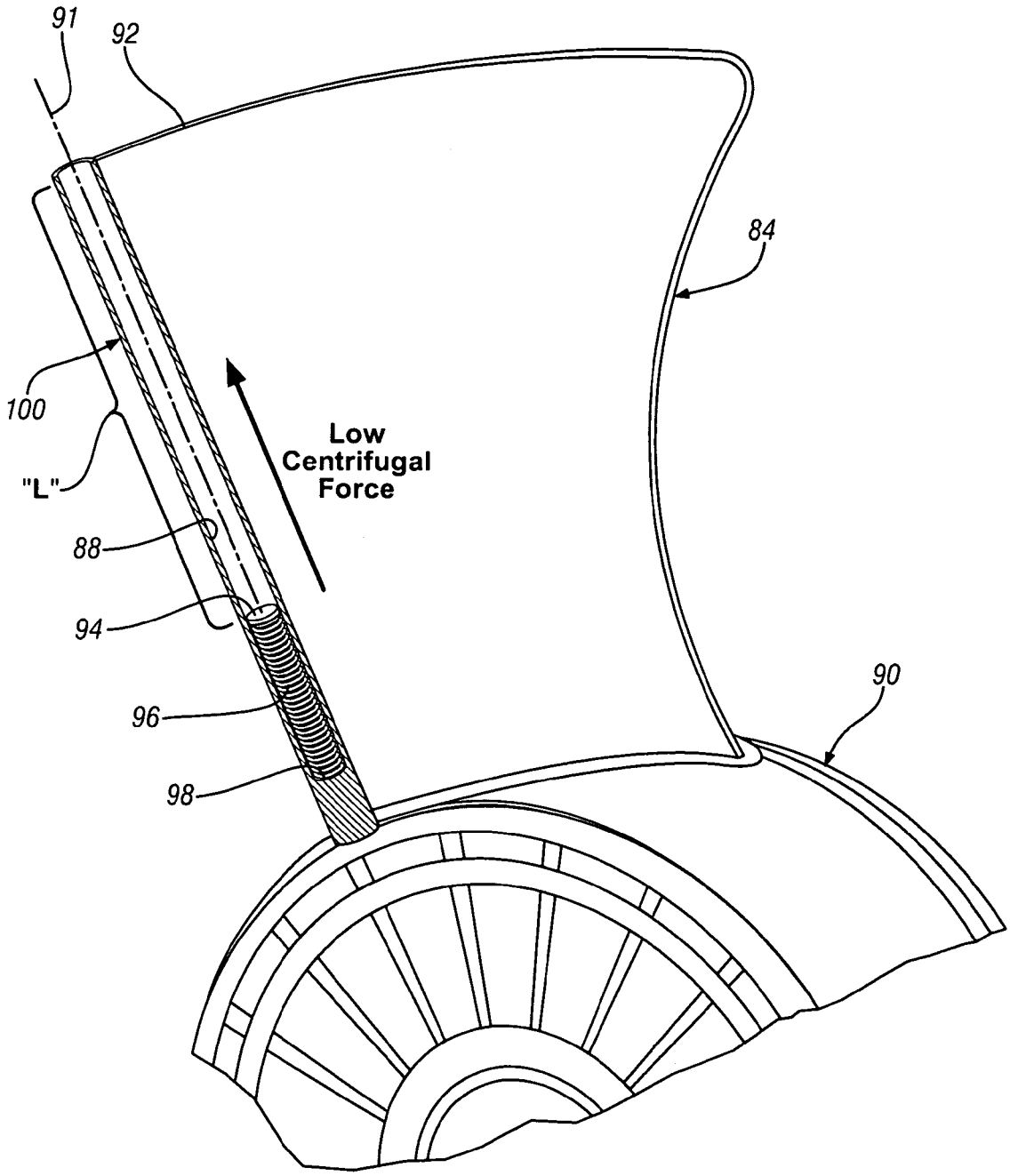
FIG. 6 is a partial enlarged view of a cooling fan blade of the cooling fan assembly of FIG. 5 in a first mode of operation.
Figure 7:
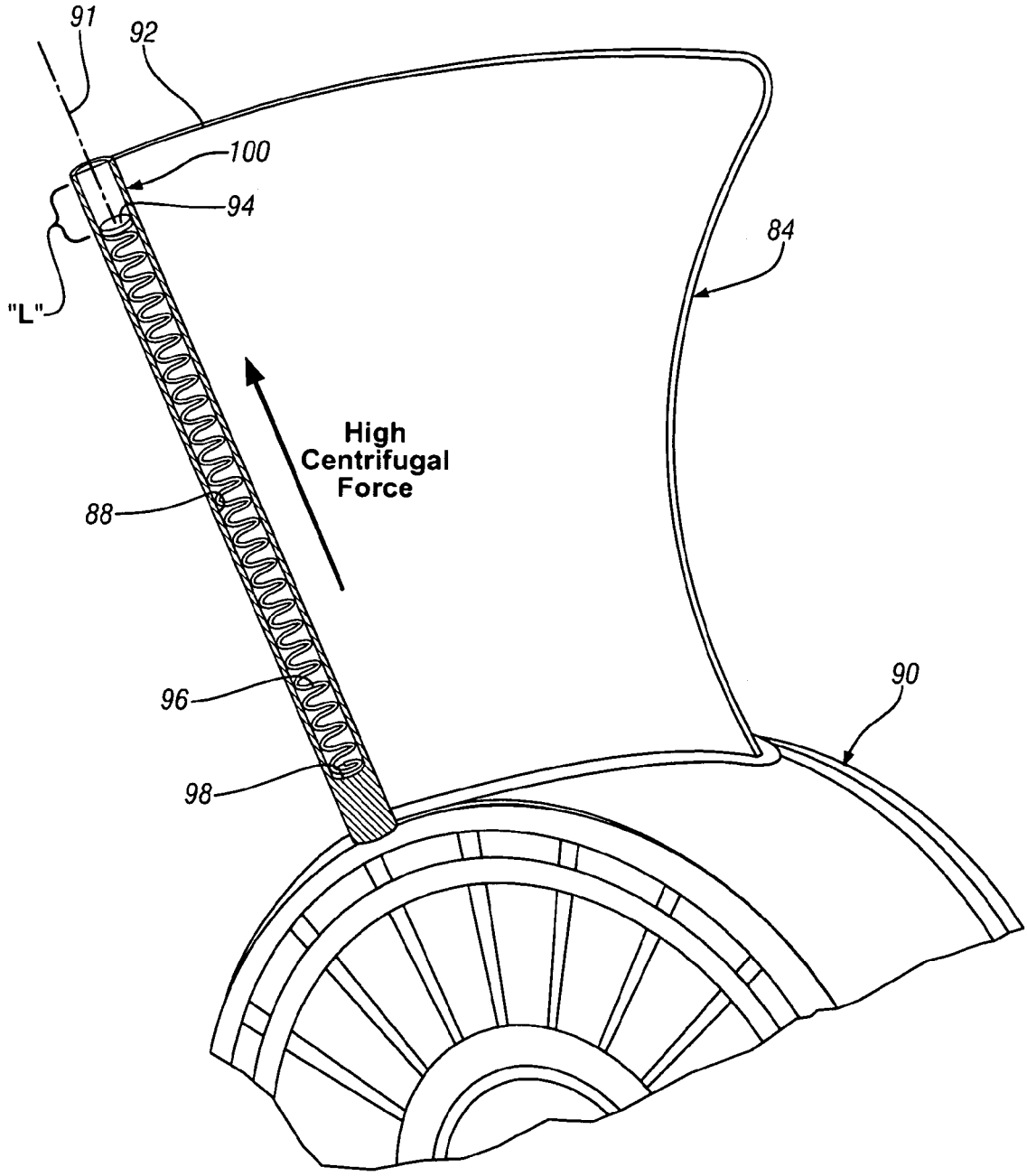
FIG. 7 is a partial enlarged view of a cooling fan blade of the cooling fan assembly of FIG. 5 in a second mode of operation.

When in operation, the fans 30 may be a significant source of generated sound especially as the plurality of radially extending portions or fan blades 84 pass stationary components such as the support brackets 86. In an exemplary embodiment, and as illustrated in detail in FIGS. 6 and 7, a portion of each fan blade 84 (in this exemplary embodiment, the leading edge of the blade) defines a chamber 88 that extends radially outwardly from a location adjacent central portion or fan hub 90 to open adjacent the fan blade tip 92. A piston 94 is disposed within each chamber 88 and is configured for axial movement within the chamber 88 along chamber axis 91. Biasing members such as springs 96 are disposed in each of the chambers 88, axially inwardly of each piston 94. Each spring 96 is attached to its respective fan blade adjacent to the inner radial end 98 of the hollow chamber 88, as well as to the piston 94 to prevent egress of the piston out of the hollow chamber 88 during rotation of the fans 30 about fan motor axis 78. Spring 96 will have a spring rate selected to provide the desired retention and extension of the piston 94 that is necessary to achieve attenuation of the desired sound frequencies (i.e. to achieve the desired quarter-wave tuning).

The fan blades 84, comprising hollow chambers 88 terminating adjacent to the fan blade tips 92, and including spring biased pistons 94, define noise attenuation devices, or quarter wave tubes 100.

During operation of the fans 30 the electric motors 82 rotate the central portions or fan hubs 90 and associated plurality of radial portions or fan blades 84 about fan motor axes 78. As a result of centrifugal force generated by the rotation of the fan blades 84, the pistons 94 will move radially outwardly against the bias of springs 96 and towards the fan blade tips 92, FIG. 7. The effect of the piston movement will be to shorten the length ("L") of each quarter wave tube 100 resulting in variable adjustment of the sound frequency that is attenuated by the tubes based on the rotational speed of the fan(s) 30. Such variation allows the sound generated by the rotation of the fans to be effectively reduced as the sound varies based on the rotational speed of the fan motors 82. A reduction in rotational speed of the fan(s) 30, and a resultant reduction in the radially outwardly directed centrifugal force imposed on pistons 94, will allow the biasing force of the springs 96 to retract the pistons 94 into the hollow chambers 88 thereby increasing the length ("L"), FIG. 6, of the quarter wave tubes 100; again variably adjusting the sound frequency attenuated. As the radial force acting on the pistons 64 is proportional to the square of the speed, a spring having a non-linear spring rate may be required for specific tuning properties over a range of rotational speed. In the alternative, if only two sound frequencies require attenuation, the springs 66 may be linear and a piston stop (not shown), that is located at a desired position along the length of the hollow chamber 88, may be used to fix the length of the tube, at speed.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A variable frequency sound attenuation device comprising:

a central portion rotatable about a first axis;

a radial portion extending outwardly from the central portion;

a chamber defined by the radial portion having a closed first end and a second end opening outwardly of the radial portion;

a second axis defined by the chamber and having a radial component thereto;

a piston disposed within the chamber for movement along the second axis in response to a centrifugal force imparted on the piston by rotation of the central portion and the radial portion about the first axis;

a biasing member having a first end fixed within the chamber and a second end fixed to the piston to limit movement of the piston along the second axis; and a variable length quarter wave chamber defined by the chamber, the second, open end of the chamber and the piston and having a variable frequency, sound attenuating length defined by the location of the piston along the second axis of the chamber.

2. The variable frequency sound attenuation device of claim 1, wherein the central portion comprises a rotor for a supercharger and the radial portion comprises a rotor lobe.

3. The variable frequency sound attenuation device of claim 2, further comprising:

a supercharger housing;

an opening in the supercharger housing adjacent to the second, open end of the chamber, wherein the chamber extends radially inwardly and axially through the rotor lobe with the second, open end located adjacent to the opening in the supercharger housing to attenuate noise adjacent the opening.

4. The variable frequency sound attenuation device of claim 3, wherein the opening in the supercharger housing comprises a combustion air inlet.

5. The variable frequency sound attenuation device of claim 2, wherein the biasing member comprises a spring having a non-linear spring rate to vary the piston movement and sound frequency attenuation of the quarter wave chamber as a function of rotational speed of the rotor and the rotor lobe about the first axis.

6. The variable frequency sound attenuation device of claim 2, wherein the biasing member comprises a spring having a linear spring rate to vary the piston movement and sound frequency attenuation of the quarter wave chamber at a first frequency generated at a first rotational speed, and at a second frequency generated at a second rotational speed of the rotor and the rotor lobe about the first axis.

7. The variable frequency sound attenuation device of claim 2, wherein the rotor comprises a plurality of rotor lobes.

8. The variable frequency sound attenuation device of claim 1, wherein the central portion comprises a hub for a fan and the radial portion comprises a fan blade.

9. The variable frequency sound attenuation device of claim 8, wherein the chamber extends substantially axially through the fan blade with the second end opening outwardly adjacent a radially outer tip of the fan blade.

10. The variable frequency sound attenuation device of claim 9, wherein the biasing member comprises a spring having a non-linear spring rate to vary the piston movement and the sound frequency attenuation of the sound attenuation chamber as a function of rotational speed of the hub and the fan blade about the first axis.

11. The variable frequency sound attenuation device of claim 9, wherein the biasing member comprises spring having a linear spring rate to vary the piston movement and the sound frequency attenuation of the quarter-wave chamber at a first frequency generated at a first rotational speed, and at a second frequency generated at a second rotational speed, of the hub and the fan blade about the first axis.

12. The variable frequency sound attenuation device of claim 9, wherein the hub includes a plurality of fan blades.

13. The variable frequency sound attenuation device of claim 9, wherein the chamber is located proximate to a leading edge of the fan blade.

* * * * *